US005179239A

United States Patent [19]

Katsui et al.

[11] Patent Number: 5,179,239

[45] Date of Patent: Jan. 12, 1993

[54] SOUND GENERATING DEVICE FOR OUTPUTTING SOUND SIGNALS HAVING A SOUND WAVEFORM AND AN ENVELOPE WAVEFORM

[75] Inventors: Masami Katsui; Yoshiyuki Terashima, both of Suwa, Japan

[73] Assignee: Seiko Epson Corporation, Tokyo, Japan

[21] Appl. No.: 747,474

[22] Filed: Aug. 13, 1991

Related U.S. Application Data

[63] Continuation of Ser. No. 504,708, Apr. 4, 1990, abandoned, which is a continuation of Ser. No. 316,008, Feb. 27, 1989, abandoned.

[30] Foreign Application Priority Data

Mar. 3, 1988 [JP] Japan ..... 63-50012
Nov. 15, 1988 [JP] Japan ..... 63-287932

[51] Int. Cl.[5] ..... G10H 1/057; G10H 1/42; G10H 1/46

[52] U.S. Cl. ..... 84/612; 84/627; 84/633; 84/DIG. 12

[58] Field of Search ..... 84/604-607, 84/609-614, 627, 633-638, DIG. 11, DIG. 12

[56] References Cited

U.S. PATENT DOCUMENTS 4,158,978 6/1979 Hiyoshi et al. ..... 84/1.03
4,273,019 6/1981 Goto .
4,328,731 5/1982 Gotho et al. .
4,449,437 5/1984 Cotton et al. ..... 84/1.01
4,526,080 7/1985 Amano .
4,554,854 11/1985 Kato .
4,682,526 7/1987 Hall et al. ..... 84/1.03
4,713,996 12/1987 Oguri .
4,815,352 3/1989 Tsukamoto et al. ..... 84/627 X

FOREIGN PATENT DOCUMENTS 86047 8/1983 European Pat. Off. .
20847880 4/1982 United Kingdom .
2115202 9/1983 United Kingdom .
2133198 7/1984 United Kingdom .

*Primary Examiner*—Stanley J. Witkowski
*Attorney, Agent, or Firm*—Blum Kaplan

[57] ABSTRACT

A sound generating device for generating a variety of sounds has a main control circuit which includes a ROM for storing melody data. A sound source is coupled to the control circuit in accordance with sound scale data stored in the ROM. The sound source has a waveform memory for storing a sound waveform in a digital form. The sound waveform memory is read at a frequency corresponding to the sound scale data. An envelope waveform memory stores an envelope waveform in a digital form. A digital to analog conversion circuit converts the digital envelope waveform in accordance with the digital sound waveform to produce an analog voltage.

29 Claims, 7 Drawing Sheets

SOUND GENERATING DEVICE FOR OUTPUTTING SOUND SIGNALS HAVING A SOUND WAVEFORM AND AN ENVELOPE WAVEFORM

This is a Continuation of U.S. patent application Ser. No. 07/504,708 filed on Apr. 4, 1990, now abandoned which is a continuation of U.S. patent application Ser. No. 07/316,008 filed on Feb. 27, 1989, now abandoned.

BACKGROUND OF THE INVENTION

The present invention relates to a sound generating device for automatically generating sound, in particular to a sound generating device which generates a melody by storing a variety of sound data in a storing circuit and successively reading this data from the storing circuit.

A conventional sound generating device is known in the art as shown in FIG. 1 and includes an oscillator 91 for providing a clock signal output. A note length generating circuit 92 variably divides the clock signal. A main ROM 93 stores data relating to note length and note scale for each note of a melody. Note length data is read from main ROM 93 into note length generating circuit 92 to determine a division ratio for dividing the output clock signal. The divided clock signal is input to a main counter 95 which in turn controls the incremental reading of the addresses of main ROM 93 in accordance with the note length.

Similarly a note scale generating circuit 94 reads note scale data from main ROM 93 and determines the division ratio for dividing the output of oscillator 91. Note scale generating circuit 94 variably divides the clock signal supplied by oscillator 91 in accordance with the calculated division ratio to output a clock signal having a frequency based upon the note scale of the note to be used in the melody. An envelope generating circuit 96 receives the divided clock signal from note scale generating circuit 94. Envelope generating circuit 96 is formed of a capacitor C and a resistor R. Envelope generating circuit 96 forms an analog wave having a predetermined shape by discharging the charge from the charged capacitor through the resistor in response to timing of the signal applied to it. The signal from note scale generating circuit 94 to which the envelope is added is supplied to a speaker so that a sound having a note scale corresponding to data stored in main ROM 93 is generated for a time period corresponding to the note length. By successively reading data from main ROM 93, a melody may be automatically produced.

This sound generating device has been satisfactory. However, the conventional sound generating device is limited to sound waveforms formed strictly as rectangular waves or waveforms wherein an exponentially curved envelope formed by a CR envelop generator is added to the rectangular wave. Therefore, tone quality deteriorates to an extent that the conventional device may only be used for sounds such as those produced by or used during the hold telephone period, melody cards or the like. Additionally, the prior art sound generating devices provide a uniform sound devoid of any sound accenting. Accordingly, the prior art sound generating devices suffer from the inability to produce a great variety of sounds, generate sound rhythms, natural sounds, stereo sounds and profound sounds. Accordingly, it is desired to provide an apparatus for generating sound which overcomes the shortcomings of the prior by providing a sound generator capable of producing a wide variety of sounds.

SUMMARY OF THE INVENTION

The sound generating device in accordance with the invention has a main ROM for storing melody information including data corresponding to sound scale. A sound source is provided for producing a sound signal. The information stored in the addresses within the main ROM is progressively read by the sound source which is controlled in accordance with the sound scale data of the melody information read from the main ROM. The sound source includes sound waveform ROM for storing the sound waveform in a digital manner. The waveform is repeatedly read from the waveform ROM at a frequency corresponding to the frequency of the sound scale data. An envelope waveform ROM stores an envelope waveform in a digital manner. The stored envelope waveform is repeatedly read from the envelope ROM. A digital to analog conversion circuit converts the envelope waveform to an analog signal. A second digital to analog conversion circuit divides a voltage signal formed by the first digital to analog conversion circuit in accordance with data output by the sound waveform ROM to produce the sound signal, wherein the frequency of the sound signal to which the envelope waveform is added is obtained from the second digital to analog conversion circuit.

A sound rhythm generator includes a pulse waveform generator and an envelope waveform generator for generating an envelope waveform. An adder circuit adds the envelope waveform to the pulse waveform. A mixer mixes the output from the adding means and the sound source to produce the sound.

In one embodiment of the invention the melody information also includes data related to the sound length and the addresses within the main storage unit are read at a speed corresponding to the sound length data. Additionally, a plurality of sound sources may be provided. The main ROM stores the sound length data as well as sound scale data for controlling each of the plurality of sound sources.

Accordingly, it is an object of the instant invention to provide an improved apparatus for generating sound of a variety of sound quality.

Another object of the invention to provide a sound generator which generates a variety of sounds including rhythm sounds of a variety of sound quality.

Yet another object of the invention is to provide a sound generator which produces free sound waveforms and envelope waveforms as well as providing sound accents.

Still other objects and advantages of the invention will in part be obvious and will in part be apparent from the specification.

The invention accordingly comprises features of constructions, combinations of elements and arrangements of parts which will be exemplified in the construction hereinafter set forth and the scope of the invention will be indicated in the claims.

BRIEF DESCRIPTION OF THE DRAWINGS

For fuller understanding of the invention, reference is had to the following description taken in connection with the accompanying drawings, in which.

DETAILED DESCRIPTION OF THE PREFERRED EMBODIMENTS

Figure 1:
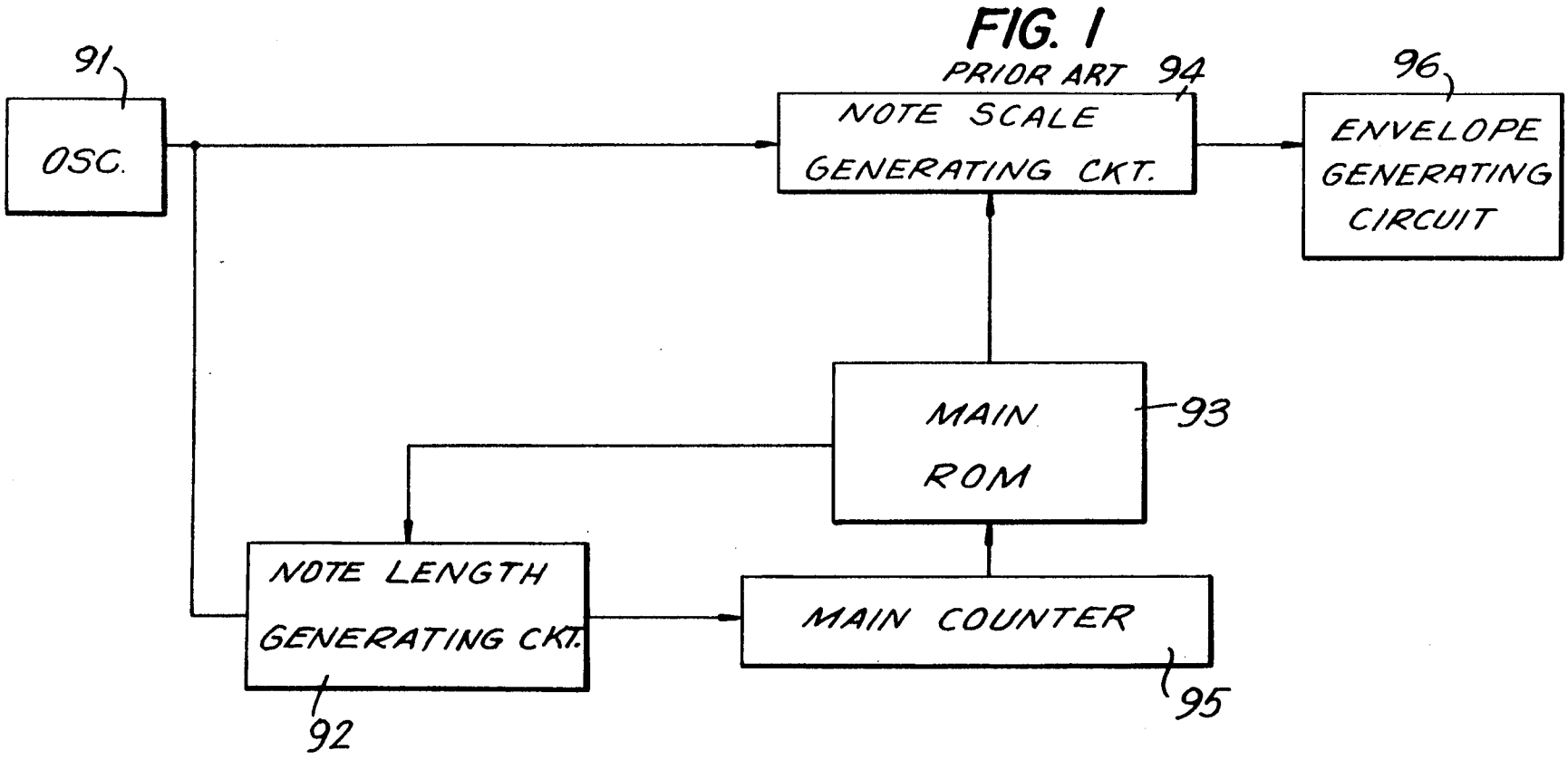
FIG. 1 PRIOR ART
FIG. 1 is a block diagram of a sound generator constructed in accordance with the prior art.
Figure 2:
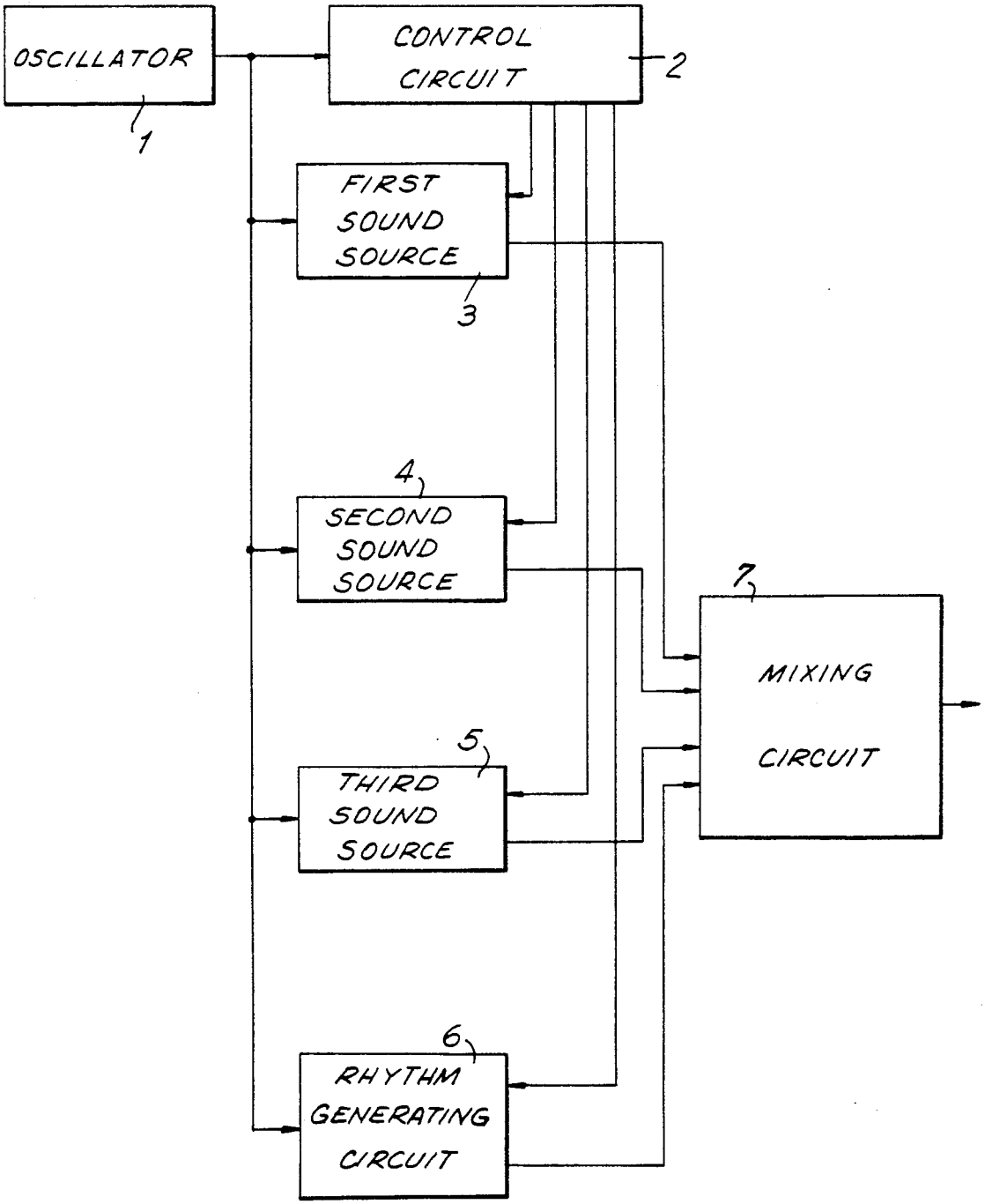
FIG. 2 is a block diagram of a sound generating device constructed in accordance with the present invention.

Reference is made to FIG. 2 wherein a block diagram of a sound generating device, generally indicated at 10 constructed in accordance with the invention is shown. Sound generator 10 includes an oscillator 1 which provides a clock output. As will be described in greater detail below, a control circuit 2 receives the clock output and provides control signals to a first sound source 3, a second sound source 4, a third sound source 5 and a rhythm generating circuit 6. First sound source 3, second sound source 4, third sound source 5 and rhythm generating circuit 6 each also receive a timing signal generated by oscillator 1 and in accordance with control signals sent from control circuit 2 produce a sound signal. A mixing circuit 7 receives each sound signal, combines the outputs and produces a sound output.

Figure 3:
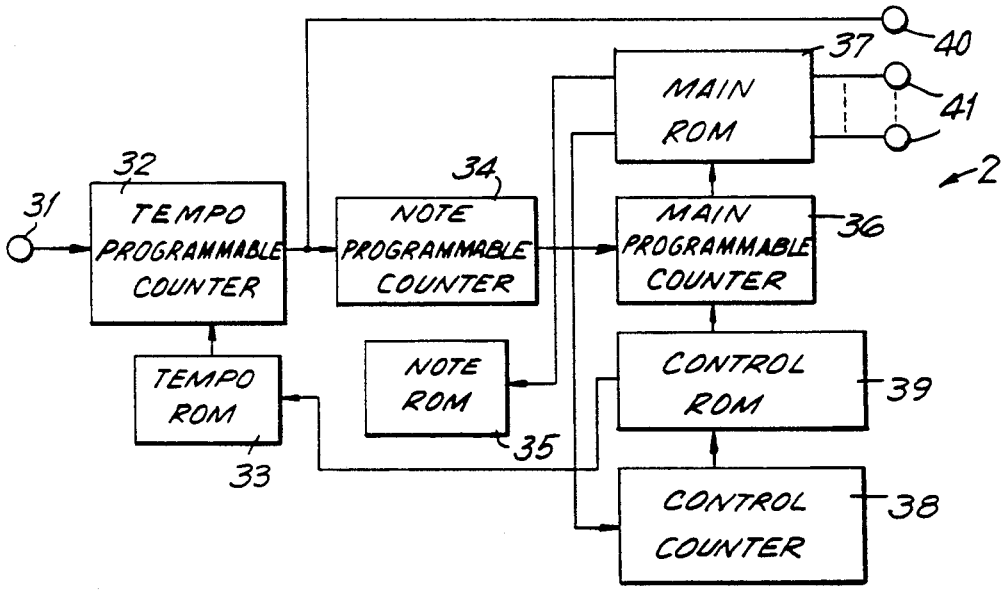
FIG. 3 is a block diagram of a control circuit constructed in accordance with the present invention.

Reference is now made to FIG. 3 in which a block diagram of control circuit 2 is provided. An input terminal 31 receives the timing signal produce by oscillator 1. A tempo programmable counter 32 generates a tempo signal by variably dividing the frequency of the timing signal input at terminal 31. A tempo ROM 33 stores the tempo division ratio for setting the division ratio of tempo programmable counter 32. A control ROM 39 provides a control signal to tempo ROM 33 for determining the address in tempo ROM 33 utilized in controlling tempo programmable counter 32 to provide a tempo signal which acts a tempo clock.

A note programmable counter 34 receives the tempo signal and generates a note length timing signal by variably dividing the tempo signal produced by tempo programmable counter 32. A note ROM 35 stores division ratios corresponding to different note lengths for variably setting the division ratio of note programmable counter 35. A main ROM 37 contains note length data which is transmitted to note ROM 35. Main ROM 37 also stores various note data for each note of a melody such as note scale for each of the sound sources as well as rhythm volume, rhythm separation and jump data for executing repetitions of a musical score. Main ROM 37 controls note ROM 35 to control the division ratio of note programmable counter 34. Therefore, a clock pulse having a frequency corresponding to the note length is output by note programmable counter 34.

A main programmable counter 36, including resettable flipflops, counts the pulses output by note programmable counter 34. Main programmable counter 36 selects addresses within main ROM 37 each time main programmable counter 36 is increased by a note. Therefore a feedback system for controlling the note length is provided by note ROM 35, note programmable counter 34, main programmable counter and main ROM 37.

A control counter 38 counts jump data stored in main ROM 37. Jump data is generated to return the address being read of main ROM 37 to the first address of the sequence, such as a repetition bar when a repetition of a bar is necessary during a musical score. A control ROM 39 stores the address to which main ROM 37 is jumped by control counter 38. The address of control ROM 39 is incremented by control counter 38. The jump address is programmed by setting or resetting main programmable counter 36 with the output of data stored in control ROM 39, so the address of main ROM 37 becomes jumped. On the other hand, an output from control ROM 39 addresses the tempo ROM 33 so that the tempo may also be jump changed.

Control circuit 2 provides an output through two groups of terminals 40 and 41. Output terminal 40 provides the tempo clock output of the melody produced by tempo programmable counter 32. Output terminals 41 produces the output of note data stored in and produced by main ROM 37 such as note scale, sound volume, sound separation for each sound source and rhythm sound data and volume, as well as the separation of the rhythm sounds. Output terminals 40 and 41 are each input to first sound source 3, second sound source 4, third sound source 5 and rhythm sound generating circuit 6. Main ROM 37 stores sound data in parallel corresponding to each sound source 3, 4, 5 and rhythm generating circuit 6 so that main ROM produces a parallel output for each data type through output terminals 41.

Figure 4:
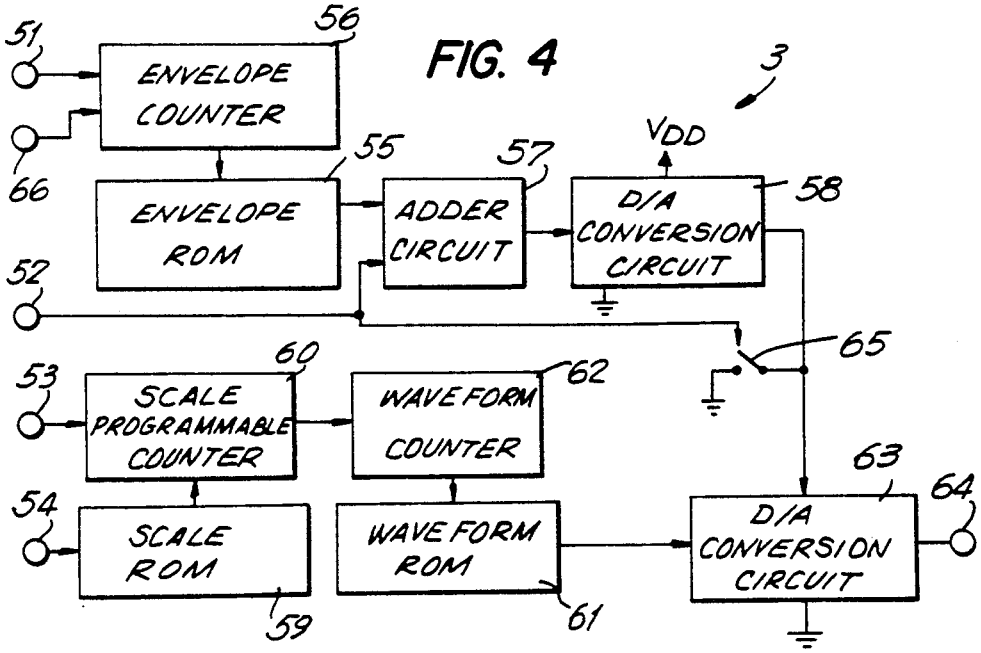
FIG. 4 is a block diagram of a sound source constructed in accordance with the present invention.

Reference is now also made to FIG. 4 wherein a block diagram of first sound source 3 is provided. First sound source 3 is used by way of example. Sound source 3 receives a plurality of inputs. The tempo clock produced by tempo programmable counter 32 is input from output terminal 40 of control circuit 2 through input terminal 51. Sound volume data for each note output by data note output terminals 41 from main ROM 37 is input through an input terminal 52. An input terminal 54 receives sound scale data for each note of the note data output by output terminals 41. An input terminal 66 inputs sound separation data of the note data output by output terminals 41. The output of oscillator 1 is input through an input terminal 53.

An envelope ROM 55 stores digital data corresponding to the sound envelope waveform. An envelope counter 56 counts the output of tempo programmable counter 32, the tempo clock input of input terminal 51. The output from tempo programmable counter 32 corresponds to the frequency clock of the shortest note length for incrementing the read address of envelope ROM 55. Envelope counter 56 also inputs data of 0 or 1 representing the sound separation based upon the sound separation input from input terminal 66. When the data value is 1, the sounds are separated so that the counted contents are instantaneously reset and the address of envelope ROM 55 is returned to the first address. Conversely, when the data value is 0 each of the notes are tied together and counting continues so that the output of the envelope waveform is continuous.

A first adder circuit 57 receives the envelope waveform produced by envelope ROM 55 and adds volume data to the output envelope shape. First adder circuit 57 adds the sound volume data input by input terminal 52 and upwardly shifts the envelope shape in parallel to a degree mandated by the sound volume data so that the entire waveform is shifted equivalently to the desired sound volume.

A first digital to analog conversion circuit 58 ("D/A") converts the digital envelope added data output by first adder circuit 57 into an analog voltage value. The output voltage is the voltage between a source voltage $V_{DD}$ and a reference voltage $V_R$in accordance with the digital output data from first adder.

A scale programmable counter 60 divides oscillating timing signal input at input 53. The division ratio of scale programmable 60 is determined by data stored within a scale ROM 59. The address of scale ROM 59 is controlled by sound scale data output by main ROM 37. The frequency of the oscillation signal is divided into a frequency which is N times the frequency of the sound scale of the note which is being output. A waveform counter 62 is a N-system counter for counting the output from scale programmable counter 61. A waveform ROM 61 stores waveform data read out at the frequency of the sound scale desired to be output.

The waveforms are preprogrammed in digital form for storage in waveform ROM 61 in accordance with a desired output tone such as a piano sound, violin sound or the like. Waveform ROM 61 has N addresses. Therefore, waveform data is repeatedly read at a frequency which makes the read time for data corresponding to one waveform from waveform ROM 61 equal to one period. This frequency is N times sound scale frequency.

A second D/A conversion circuit converts the digital wave form data from waveform ROM 61 into an analog voltage waveform by dividing the analog voltage value input from first D/A conversion circuit 58 or a reference voltage by the digital data output from waveform ROM 61. Second D/A conversion circuit 63 outputs a divided voltage as an output voltage to output terminal 64.

The maximum voltage output by D/A conversion circuit 63 is the voltage output by first D/A conversion circuit 58. The digital waveform stored in waveform ROM 61 is converted to an analog voltage by D/A conversion circuit 63 and limited by the output of D/A conversion circuit 58 to produce a sound signal output at terminal 64.

A switch 65 is connected between the output of D/A conversion circuit 58 and a reference voltage. The switch is switched on when sound volume data input at input terminal 52 indicates a soundless state, converting the voltage input to the D/A conversion circuit 63 to a reference voltage $V_R$. As a result, because only a reference voltage is supplied to D/A conversion 63, no operation is performed and there is no output of waveform at output terminal 64.

Figure 5:
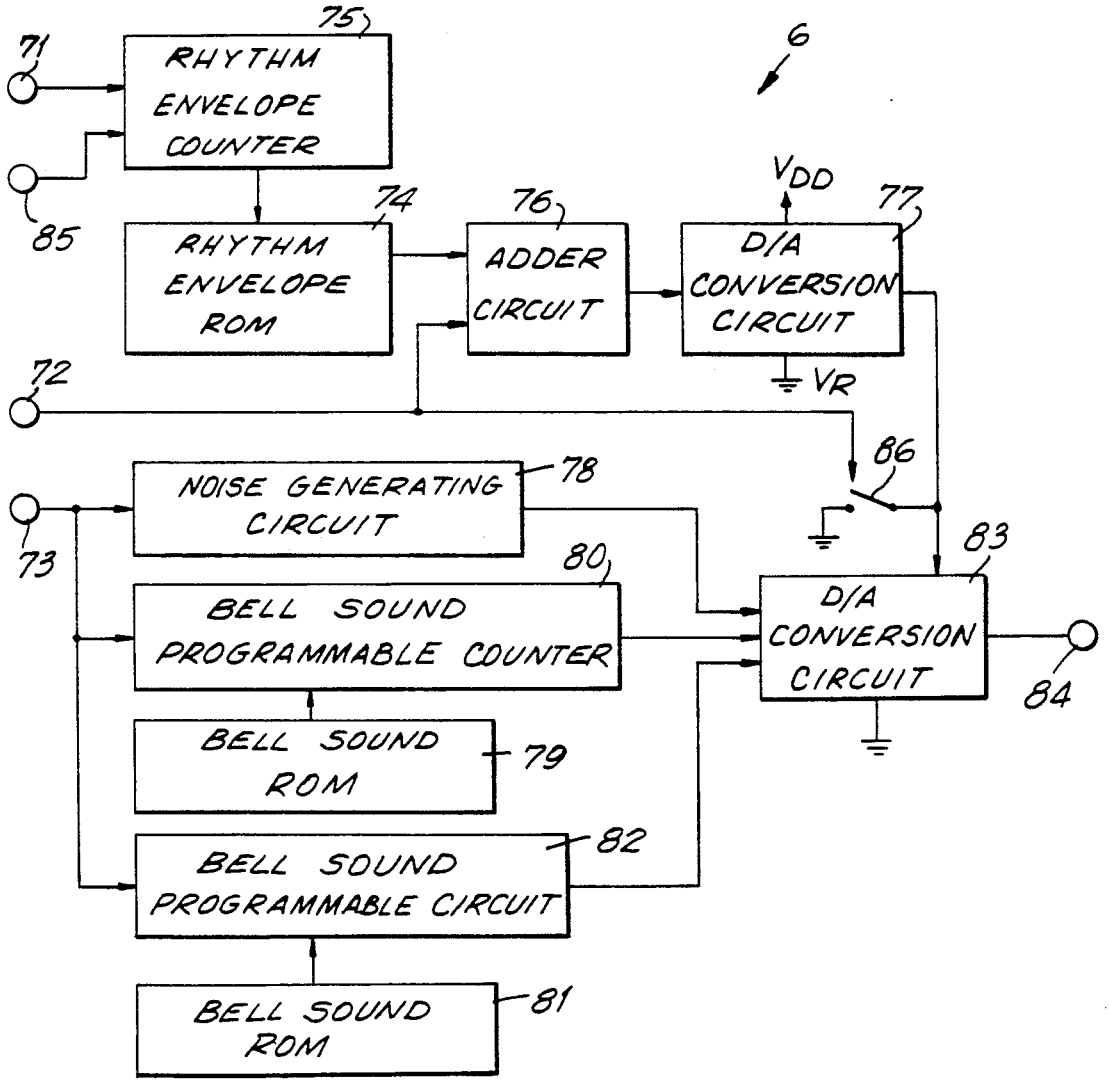
FIG. 5 is a block diagram of a rhythm sound generating circuit constructed in accordance with the present invention.

Reference is now made to FIG. 5 in which an example of rhythm generating circuit 6, constructed in accordance with the invention is provided. Rhythm generating circuit 6 also has a plurality of inputs. The tempo clock produced by tempo programmable counter 32 is input at input terminal 71. Rhythm sound volume data output by main ROM 37 is input at input terminal 72. Rhythm sound separation data output by main ROM 37 is input at input terminal 85. The timing signal output by oscillator 1 is input at input terminal 73.

A rhythm envelope ROM 74 stores data obtained by converting the envelope shape of the rhythm sound waveform into a digital value. A rhythm envelope counter 75 increments the address of rhythm envelope ROM 74 by counting the output from tempo programmable counter 32 which corresponds to the clock frequency of the shortest note. Rhythm envelope counter 75 operates in response to data of 0 or 1 input from input 85. When the input is 1 there is a rhythm sound separation and the address of envelope ROM 74 is instantaneously reset to the first address position. When the input data is 0, no resetting is performed.

A second adder circuit 76 adds digital data to the rhythm sound envelope output by rhythm envelope ROM 74. Second adder circuit 76 also adds rhythm sound volume data output by main ROM 37 to shift the envelope shape upwards by a degree corresponding to the input sound volume data to equivalently increase the entire waveform by the sound volume data amount.

A third D/A conversion 77 circuit converts the digital envelope data produced by adder circuit 76 into an analog voltage. D/A conversion circuit 77 operates in a manner similar to D/A conversion circuit 58 of sound source 3 and is connected between a source voltage $V_{DD}$ and a reference voltage $V_R$ and therefore the output is changed between two voltage values.

A noise generating circuit 78 includes a shift register formed by a plurality of flip-flops and an EXOR circuit for receiving the outputs from a specific two of the flip-flops. The input from oscillator 1 acts as a clock input for the flip-flops. A first bell sound ROM 79 and a second bell sound ROM 81 are provided for storing frequency data for two sounds having rectangular shaped waveforms. A first bell sound programmable counter 80 and a second bell sound programmable counter 82 receive the timing signal oscillator 1 and divide the oscillated frequency in accordance with divisional ratios determined by the data stored in sound ROM 79 and sound ROM 81 respectively to produce respective sound frequencies generated in a rectangular form.

A fourth D/A conversion circuit 83 receives the analog voltage output of third D/A conversion circuit 77, a noise signal output by noise generating circuit 78 and the rectangular outputs from bell sound programmable counters 80 and 82. D/A conversion circuit 83 combines these inputs into an analog voltage having a maximum value of the output of D/A conversion circuit 77. The analog voltage is a rhythm sound output at output terminal 84. The rhythm sound is formed by combining the noise signal and rectangular waveforms having distinct frequencies and the envelope waveform.

A switch 86 is switched on when the rhythm sound volume data input at input terminal 72 corresponds to the soundless state. When switch 86 is turned on the output from D/A conversion circuit 77 is forced to become the reference voltage level. As a result, because the maximum voltage corresponds to the output of D/A conversion circuit 77, only the reference voltage is supplied to D/A conversion circuit 83 and no rhythm sound signal is output at terminal 84. Additionally, the output terminals of noise generating circuit 78, bell sound programmable counters 80, 82 and the input terminal of the D/A conversion circuit 83 are selectively masked in the process of manufacturing the sound generating device in the form of an Integrated Circuit.

Accordingly, only the needed rhythm sound is arranged to be an output.

Figure 6:
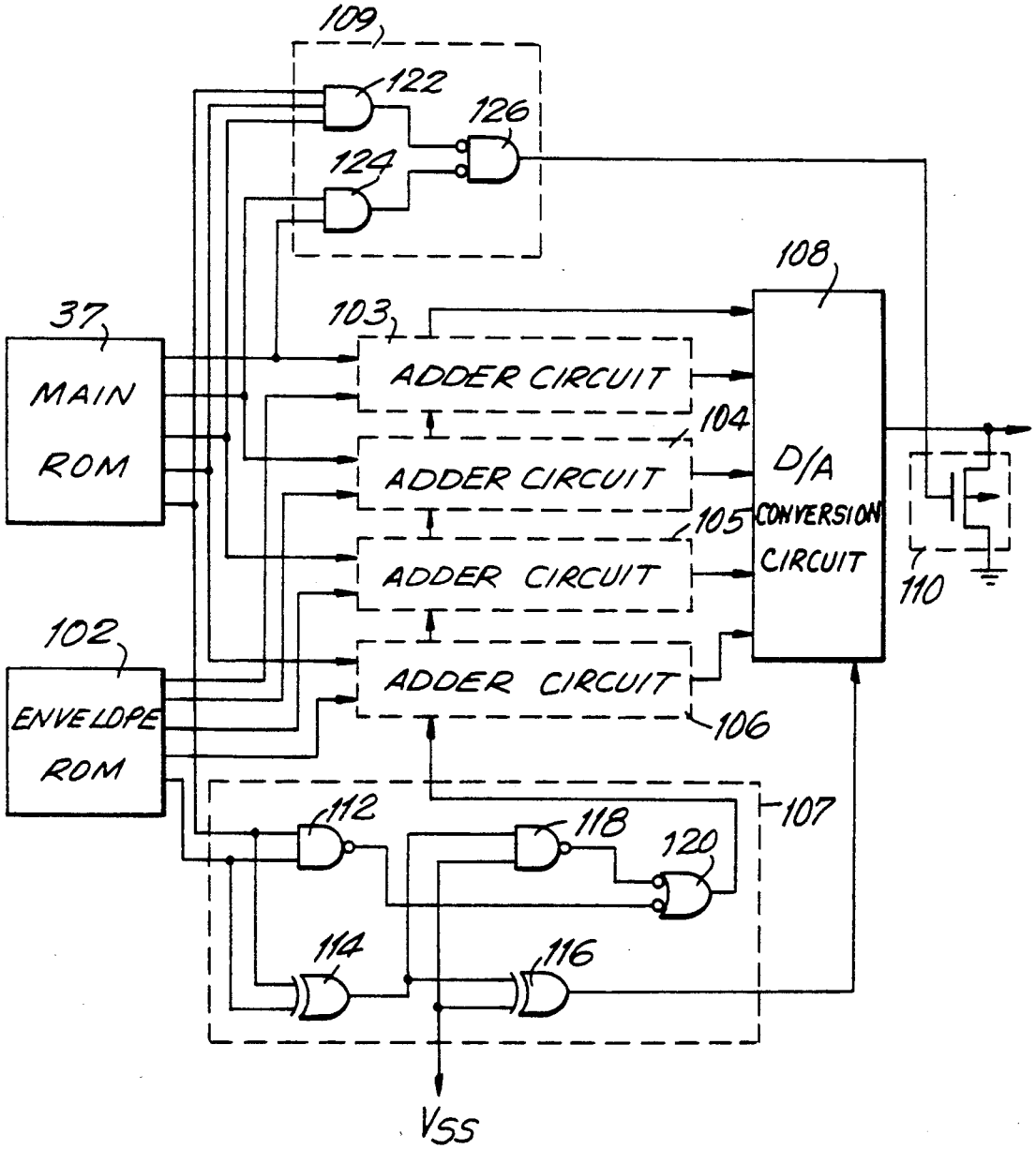
FIG. 6 is a block diagram of a sound volume control circuit constructed in accordance with the present invention.

Reference is now made to FIG. 6 wherein a sound volume and rest circuit provided in each sound source and rhythm sound generating circuit is shown. Main ROM 37 provides an input to a plurality of adder circuits 103, 104, 105, 106 and 107. Adder circuits 103, 104, 105, 106 and 107 also receive inputs from an envelope ROM 102. Adders 103–107 add the sound volume data of main ROM 37 to the envelope data of envelope ROM 102.

Each adder circuit spills into the next one so that once filled, the overflow is carried over into the next sequential adder circuit. By way of example, adder circuit 107 represents the addition up to the lower most bits and its carry over is input to adder circuit 106. Similarly, the carry over of adder circuit 106 is input to adder circuit 105 whose carry over is input to adder circuit 104.

The internal construction of adder circuit 107 is illustrated by way of example within the dashed lines. Adder circuit 107 includes a NAND gate 112 and EXOR gate 114 each having an input from main ROM 37 and envelope ROM 102. A NAND gate 118 has an input from EXOR gate 114 and a voltage source $V_{SS}$. An EXOR gate 116 having an input from EXOR gate 114 and voltage source $V_{SS}$ provides an output to a D/A conversion circuit 108. An OR gate 120 having inverted inputs from NAND gate 118 and NAND gate 112 produces an output to adder circuit 106. The structures of adder circuits 104 through 106 are similar to that of adder circuit 107.

D/A conversion circuit 108 receives the input of each adder circuit 103–107 and provides an analog envelope waveform voltage. A NOR circuit 109 receives inputs from main ROM 37 and envelope ROM 102 and detects when a sound data volume generated by main ROM 37 becomes zero, i.e. a pause state. NOR circuit 109 includes two NAND gates 122, 124 providing inputs through inverted terminals to an AND gate 126 which produces the output of NOR circuit 109. A MOS switch 110 receives the output of NOR circuit 109 and D/A conversion circuit 108 and forces the output of D/A conversion circuit 108 to become a reference voltage when the output from NOR circuit 109 is high. Accordingly, MOS switch 110 acts in a manner equivalent to switches 65 and 86 discussed above.

Reference is now particularly made to FIGS. 2 through 6 to describe the operation of the entire sound generating device 10. Oscillator 1 includes an oscillating circuit such as a capacitor resistor oscillating circuit, crystal oscillating circuit or ceramic oscillating circuit which produces a desired oscillation frequency. The timing signal output by oscillator 1 having the oscillation frequency is input to sound source 3, sound source 4, sound source 5 and rhythm generating circuit 6. Additionally, a divided frequency obtained by dividing the oscillation frequency by M is input to control circuit 2 and rhythm sound generating circuit 6. However, the oscillation frequency may be utilized as produced without dividing the frequency by M.

The timing signal output by oscillator 1 is input at input terminal 31 where the oscillation frequency is divided into a frequency having a desired tempo by tempo programmable timer 32. For example, it is assumed that the frequency input to tempo programmable counter 32 is 128 Hz and the shortest note utilized by sound generator 10 is ♪ (a 1/32 note). In general, the tempo is determined so that a quarter note (♩) equals 60. The tempo or speed is set so that 60 quarter notes are generated in a minute and a quarter note may be generated each second. Since ♪ eight times the speed of ♩, eight 32nd notes are generated each second. If the 32nd note is the shortest note in the system, tempo programmable counter 32 must output a frequency in which eight ♪ may be output in a second. This necessitates that tempo programmable counter 32 divide the input frequency of 128 Hz to an output of 8Hz. Therefore, to make ♩ =60 it is sufficient to divide 8 by 128 which obtains 1/16 divisions by tempo programmable counter 32. Where tempo programmable counter 32 is a five bit counter, thirty-two types of tempo may be set between a range of 1/1 division ratio to 1/32 division ratio by setting data stored in tempo ROM 33 at a value in the range from 00000 to 11111. Utilizing these thirty-two types of divisions it is possible to obtain the situation where the relation ♩ =60 can be realized and the tempo may be set from ♩ =30 to ♩ =960. By storing certain division numbers of the thirty two types of division numbers within tempo ROM 33 and having the address selected within tempo ROM 33 controlled by an output from control ROM 39 the tempo may be changed during the playing of a melody.

The frequency of the shortest note output from tempo programmable counter 32 is input to note programmable counter 34. In this example note programmable counter 34 is structured similarly to tempo programmable counter 32, i.e., having five bits available therein, and having the address of note ROM 35 being selected in accordance with note related data output by main ROM 37. Therefore, a division ratio between 1 and 32 may be obtained utilizing five data bits. This results in the outputting of notes of the desired frequencies extending from the shortest note ♪ to the longest note ○ (whole note).

The clock signal having the note frequency output by note programmable counter 34 is counted by main programmable counter 36. Address selection within main ROM 37 is performed in accordance with the count value output by main programmable counter 36 to advance the address of main ROM 37. Main ROM 37 stores data related to all of the notes within a melody including note length data, jump data, sound scale data for each of the sound sources and sound volume data and sound separation data for each of the sound sources and the rhythm generating circuit.

When jump data corresponding to a particular note data becomes 1, it is counted by control counter 38. Data stored by control ROM 39 is output for setting or resetting a flip-flop forming main programmable counter 36 so that data corresponding to the jump address of main ROM 37 is set to perform an address jump of the read address of main ROM 37. Control ROM 39 stores the address to which main ROM 37 is jumped so that the next jump address is selected at each count of control counter 38.

Figure 7:
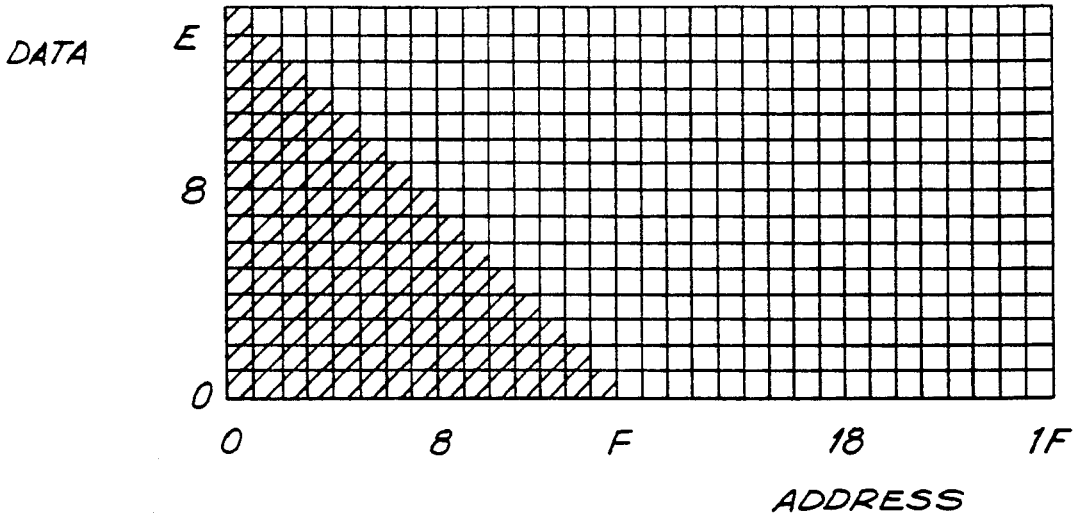
FIG. 7 is a graphical representation of a saw shaped waveform as stored in an envelope memory constructed in accordance with the present invention.

Reference is now made more specifically to FIG. 4 wherein the operation of a sound source in conjunction with control circuit 2 is provided. The clock signal output by tempo programmable counter 32 is input to envelope counter 56 through input terminal 51. Envelope ROM 55 stores data obtained by converting an envelope shaped waveform into a digital value. For example, when a saw shaped enveloped is formed utilizing four data bits, the data is stored in the addresses 0 to 1F of envelope ROM 55 as shown in FIG. 7. Main ROM 37 stores data determining whether it is necessary to provide note separation at each note. If separation data is present in the note data, a resetting signal is supplied to envelope counter 56 through input 66 by short pulses at each note separation. As a result, the read address of envelope ROM 55 is set at the zero address. Envelope counter 56 counts at a frequency corresponding to the shortest note's tempo produced by tempo programmable counter 32 to successfully cause envelope data to be read from envelope ROM 55.

Sound volume data for each note is stored in main ROM 37 and is input to sound source 3 through input terminal 52. The sound volume data is added to the read envelope data output from envelope ROM 57 by adder circuit 57. Because the envelope data is increased by a degree corresponding to the sound volume data, sound volume adjustment for each note can be performed. Digital data corresponding to the envelope data output by adder circuit 57 is converted into an analog voltage by first D/A conversion circuit 58.

Division data for dividing the oscillating signal is stored in scale ROM 59. Sound scale data contained in main ROM 37 is input to scale ROM 59 through an input terminal 54 to determine the address of scale ROM 59 thereby determining the division ratio to be utilized in controlling scale programmable counter 60. Scale programmable counter 60 receives the clock signal output by oscillator 1 through an input 53 and divides the frequency to output a clock signal having a frequency which is N times the frequency desired to be output. For example, where a sound scale of C4=256 Hz is utilized, assuming that oscillation frequency is 262.144 kHz and N=32, a division of 1/32 is needed.

Figure 8:
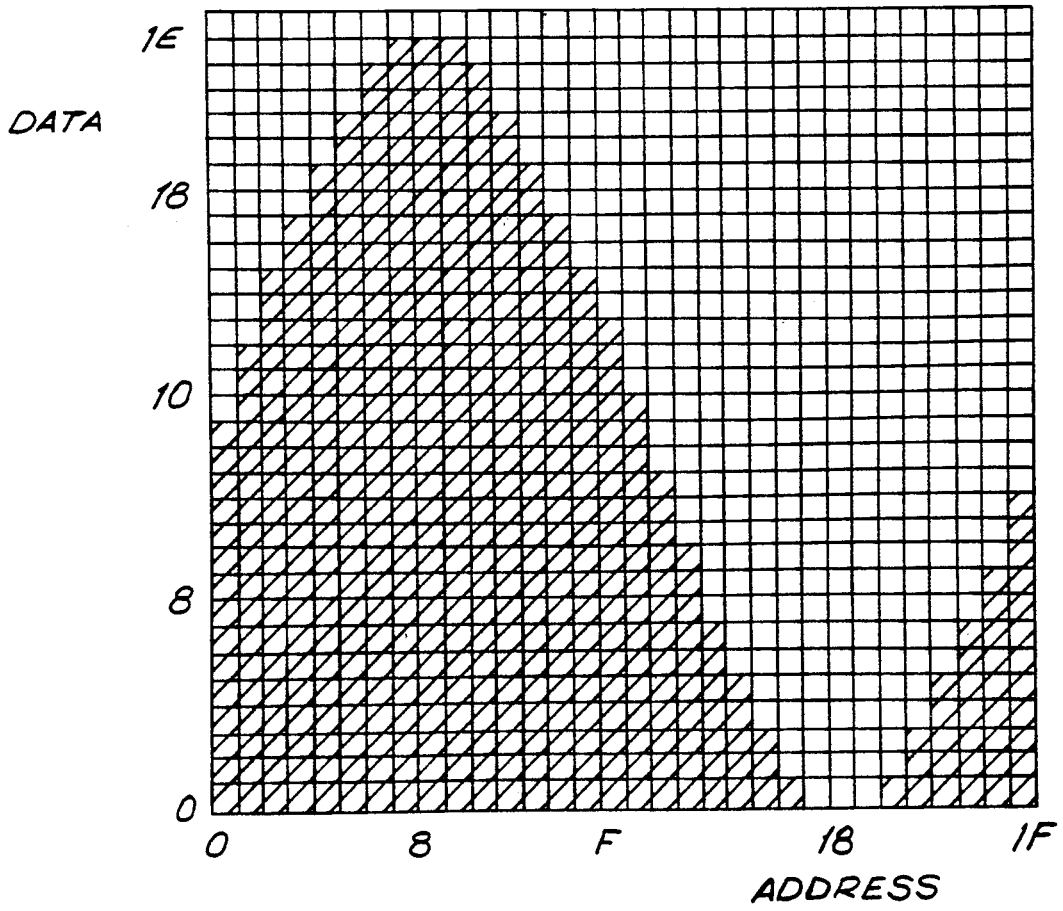
FIG. 8 is a graphical representation of a sine waveform as stored in an envelope memory constructed in accordance with the present invention.

Waveform counter 62 receives the clock signal output by scale programmable counter 60 and the address of waveform ROM 61 being readout is incremented. Waveform counter 62 is on an N-system. Waveform ROM 61 stores data obtained by converting a sound waveform into a digital value. Waveform ROM 61 stores N digital waveform data points at N addresses. These addresses are read out by waveform counter 62 which may count as high as N. For example, where a number (N) of addresses of waveform ROM 61 is thirty two and the number of data is thirty two, by writing a sine wave, the data shown in FIG. 8 may be obtained. Therefore, when waveform counter 62 completes counting a single waveform is output. The frequency at which this waveform is repeatedly read out is the frequency of the sound scale. To change a sound scale the clock frequency output by waveform counter 62 must be changed and in turn the clock frequency of scale programmable counter 60 must be changed.

The digital waveform data output from waveform ROM 61 is input to second D/A conversion circuit 63. However, because second D/A conversion circuit 63 has a maximum operating voltage of the first D/A conversion circuit 58 which produces the envelope, and a minimum operating voltage of a reference voltage as selected by switch 65, the final output at output terminal 64 becomes a waveform in an analog shape in which the analog envelope waveform had been divided by the sound waveform. That is in second D/A conversion circuit 63, an analog output voltage from first D/A conversion 58 is divided in accordance with data output from waveform ROM 61 and is output through output terminal 64. Furthermore, when sound volume data output to that particular sound source is 0, switch 65 is switched on so that output from the sound source is prevented. This switch may equally be placed between the output from second D/A conversion circuit 63 and the reference voltage.

Reference is more particularly made to FIG. 5 wherein the operation of rhythm sound generating circuit 6 will be provided. The clock output from tempo programmable counter 32 is input to a rhythm envelope counter 75 through input terminal 71. Rhythm envelope ROM 74 contains data obtained by converting the rhythm sound envelope into a digital value. Rhythm envelope counter 75 increments the read address of rhythm envelope ROM 74. Adder circuit 76 adds the digital envelope data output by rhythm envelope ROM 74 and rhythm sound volume data input from main ROM 37 through input terminal 72 and outputs an envelope rhythm added waveform signal in digital form. D/A conversion circuit 77 converts the input waveform signal into an analog voltage value.

A clock signal having an oscillation frequency 1/M the oscillation frequency of the clock signal output by oscillator 1 is input through input terminal 73 to noise generating circuit 78 and bell sound programmable counters 81, 82. Noise generating circuit 78 includes a multi-step shift register and an EXOR circuit which receives input from the outputs of a specific two of the flip-flops of the shift register. The output of the EXOR is re-input at the first step of the shift register. As a result, white noise, in which the clock frequency to be input to the shift register is made the maximum frequency, is generated.

Bell sound ROMs 79 and 81 store sound frequency data in rectangular form. Bell sound programmable counters 81 and 82 divide the input frequency in accordance with division ratio data output by bell sound ROMs 79 and 81 resulting in the output of the rectangular shape pulses of a desired sound frequency. D/A conversion circuit 83 mixes the noise produced by noise generating circuit 78 and the rectangular waves of different frequencies produced by a plurality of bell sound programmable counters 80 and 82. By setting the maximum operating voltage of D/A conversion circuit 83 to be the output voltage of D/A conversion circuit 77, rhythm sound to which an envelope is added can be output. By adding noise waves and rectangular waves along with the addition of the envelope, rhythm sounds such as percussion sounds relating to drums, cymbals, bells or the like can be freely synthesized.

The analog voltages representing sounds produced by the plurality of sound sources and the analog voltage produced by rhythm sound generating circuit 6 are mixed by mixing circuit 7 to produce an analog voltage representing sound.

Figure 9:
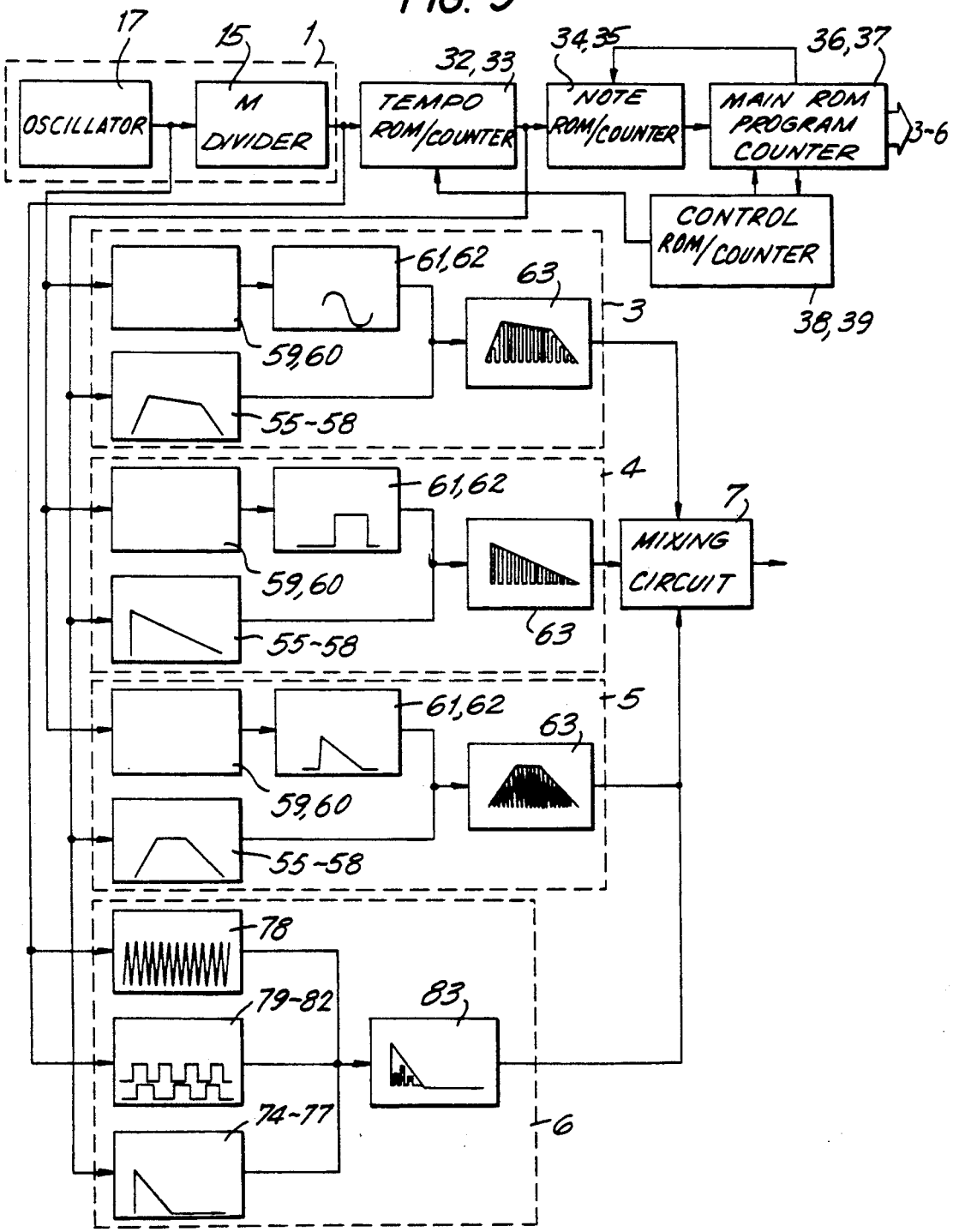
FIG. 9 is a block diagram illustrating the relationship between waveforms produced in accordance with the present invention.

Reference is now made to FIG. 9 wherein a waveform chart representing the operation of sound generator 10 is provided. Oscillator 1 produces a clock signal input to sound sources 3, 4 and 5 and to rhythm generating circuit 6. An M divider 15 is contained within oscillator 1 and provides a divided signal input to control circuit 2 and rhythm generating circuit 6. In the example of FIG. 9 sound source 3 produces a sine wave as stored in waveform ROM 61 and read out by waveform counter 62. Sound source 4 stores a rectangular wave in waveform ROM 61 and sound source 5 stores a saw tooth waveform in waveform ROM 61. As discussed in greater detail above, each of the waveforms stored in waveform ROM 61 is added to an envelope waveform stored in envelope ROM 55 and converted into an analog voltage output by D/A conversion circuit 63. These outputs are input to mixing circuit 7.

Similarly, in rhythm generating circuit 6, saw tooth noise is generated by noise generating circuit 78 while two rectangular having distinct frequencies are generated by sound programmable counter 80 and 82. These waves are added to a saw tooth envelope stored in rhythm envelope ROM 74 and combined by D/A conversion circuit 83 to provide an analog output to be mixed at mixing circuit 7. Control circuit 2 provides a control output from main ROM 37 to control the envelope of sound sources 3, 4 and 5. By forming the waveform and instrument envelope in wave form ROM and envelope ROM, a variety of sounds can be generated.

By providing a sound generating device having a plurality of sound sources in which each sound source has a memory for storing sound waveforms and envelope waveforms, memory data of each waveform may be rewritten in the device providing a greater variety and freer sound quality with respect to conventional sound generating devices which are limited to a single uniform sound quality. Additionally, by adding accent data such as sound volume data stored in a note information memory and envelope waveform data, sound volume adjustment corresponding to each note may be performed.

Additionally, by providing memory within each sound source and a control memory within the device, the system may be operated without any control from an outside microcomputer and music may be automatically played. Because a plurality of sound sources each having individual sound quality are provided by adding a rhythm sound, a wide, profound and less artificial performance may be realized. Additionally, natural sounds such as birds, insects, or the like, wind, wave and water as well as imitation sounds may be produced in addition to musical sounds.

By providing a sound generating device constructed as disclosed above, the sound length is produced in accordance with melody data stored in the main storage unit. Note scale data for determining the note scale of the sound signal produced by the sound source is also output by the main storage unit. Simultaneously, each sound source stores waveform data and envelope waveform data of a particular sound. The sound waveform data is repeatedly read at a frequency corresponding with the note scale data.

The envelope waveform data is converted into an analog voltage value by a digital analog conversion circuit. This analog voltage value is then divided in accordance with the sound waveform data. A frequency signal formed by pulses corresponding to the sound waveform is shaped within the envelope waveform having a voltage amplitude corresponding to the envelope waveform is output. A speaker receives this output and produces a sound having optional tones in accordance with the sound waveform and additionally having variable tone lingering in accordance with the envelope waveform.

Such a structure and operation allows for a compact unitary melody integrated circuit chip to be produced which allows for a variety of sounds.

It will thus be seen from the objects set forth above and those made apparent from the preceding description are efficiently attained, and since certain changes may be made in the above construction without departing from the spirit and scope of the invention, it is intended that all matter contained from the above description or shown in the accompanying drawings shall be interpreted as illustrative and not in the limiting sense. It is also to be understood that the following claims are intended to cover all the generic and specific features of the invention herein described, and all statements of the scope of the invention which as a matter of language might be said to fall therebetween.

What is claimed:

1. A sound generating device for generating a sound signal having a sound waveform and an envelope waveform comprising:

control means for controlling the output of sound signal from the device and including main storage means for storing melody data including sound scale data which indicates a sound scale output therein; and sound source means for producing a sound signal in response to said sound scale data and coupled to said control means;

said sound source means comprising:

sound waveform storage means for storing sound waveform data in a digital manner, the sound waveform data being read from the sound waveform storage means at a frequency corresponding to the sound scale data;

envelope waveform storage means for storing envelope waveform data in a digital manner, the envelope waveform data being read from said envelope waveform storage means;

first digital to analog conversion means for converting said digital envelope waveform data into an analog voltage waveform; and second digital to analog conversion means receiving said sound waveform data and said analog voltage waveform as a voltage source for converting said digital sound waveform data into said sound signal.

2. The sound generating device of claim 1, wherein said first digital to analog conversion means converts said digital envelope waveform into an analog voltage and said second digital to analog conversion means divides the analog voltage output form the first digital to analog conversion means in accordance with the digital sound waveform data read from the sound waveform storage means, and outputs an analog voltage output.

3. The sound generating device of claim 2, wherein the main storage means stores sound volume data and said sound source means further comprises adder means for adding said sound volume data to envelope waveform and producing a signal which is input to said first digital to analog conversion means.

4. The sound generating device of claim 1, wherein said main storage means stores sound separation data, the envelope waveform storage means including a read address which is reset to the first address when the sound separation data indicates a sound separation.

5. The sound generating device of claim 3, wherein the sound source means includes switching means which is selectively connected between a reference voltage and the output of the first digital to analog conversion means or a reference voltage and the output of the second digital to analog conversion means, the switching means being switched to couple the reference voltage to the associated output when the sound volume data read from the main storage means indicates soundlessness.

6. The sound generating device of claim 4, wherein the control means produces a tempo clock signal having a tempo frequency and the envelope waveform storage means comprises an envelope counter which counts at a frequency corresponding to the tempo frequency, said envelope waveform storage means including read addresses selected by said envelope counter in accordance with an internally generated count value, the count value being reset by the sound separation data.

7. The sound generating device of claim 1, further comprising clock signal generating means for generating a clock signal having a reference frequency, and the sound source means further comprising a scale programmable counter having a division ratio determined in accordance with the scale data, the scale programmable counter dividing the reference frequency in accordance with the scale data to a divided frequency which is N times the frequency of the sound scale output and said sound waveform storage means having N read addresses, a N-system sound waveform counter for counting the output from the scale programmable counter, and the address of the sound waveform storage means being read is determined by the N-system sound waveform counter counting N pulses output from the scale programmable counter.

8. The sound generating device of claim 7, wherein said melody data includes note length data, the control means further comprising a tempo counter for dividing said reference frequency to a tempo frequency; a programmable note length counter for dividing the tempo frequency to a frequency in accordance with the sound length data read from the main storage means and providing an output; and a main counter for counting the output from the programmable note length counter for determining the read address of the main storage means.

9. The sound generating device of claim 8, wherein the sound source means further comprises an envelope counter for counting the tempo frequency, the envelope waveform storage means including a read address determined in response to the count value of the envelope counter, wherein the envelope counter is reset when the sound separation data stored within the main storage means corresponds to a sound separation.

10. The sound generating device of claim 9, wherein said main storage means stores sound volume data and said sound source means comprises an adder circuit for adding sound volume data to said envelope waveform and produces a signal, said digital to analog conversing means converting said added envelope waveform signal to an analog signal.

11. The sound generating device of claim 10, wherein said main storage means stores note data including sound volume data, sound length data and sound separation data in addresses of said main storage means.

12. The sound generating device of claim 3, wherein the main storage means stores rhythm sound volume data as part of said melody data and further comprising rhythm sound generating means for producing a rhythm sound in accordance with said rhythm sound volume data.

13. The sound generating device of claim 12, wherein said rhythm sound generating means comprises a rhythm envelope waveform storage means for storing a rhythm envelope waveform in a digital form, the rhythm envelope waveform being repeatedly read from the rhythm envelope waveform storage means; a adder circuit for adding said rhythm envelope waveform and the rhythm sound volume data; generating means for generating at least one rhythm pulse; and means for adding the voltage waveform formed by converting the output from said adder circuit to analog waveform of the rhythm pulse from the generating means

14. A sound generating device for generating a sound signal having a sound waveform and an envelope waveform comprising:

control means for controlling the output of said sound signal from the device and including main storage means for storing melody data including sound scale data which indicates a sound scale output therein; and sound source means for producing a sound signal in response to said sound scale data and coupled to said control means;

said sound source means comprising:

sound waveform storage means for storing sound waveform data in a digital manner, the sound waveform data being read form the sound waveform storage means at a frequency corresponding to the sound scale data;

envelope waveform storage means for storing envelope waveform data in a digital manner, the envelope waveform data being read form envelope waveform storage means;

first digital to analog conversion means for converting said digital envelope waveform data into an analog voltage waveform; and second digital to analog conversion means receiving said sound waveform data and said analog voltage waveform as a voltage source for converting said digital sound waveform data into said sound signal; and a speaker for receiving the sound signal and producing a sound in response thereto.

15. The sound generating device of claim 14, further comprising a speaker for receiving the sound signal and producing a sound in response thereto.

16. The sound generating device of claim 1, wherein at least two of said sound source means have different envelope waveforms stored in their respective envelope waveform storage means.

17. A sound generating device for generating a sound signal having a sound waveform and an envelope waveform comprising main storage mean for storing melody data therein, the melody data including sound length data and a plurality of sound scale data, the main storage means having read addresses therein; a first programmable counter for dividing a reference frequency in response to said sound length data to provide a signal for advancing the read address of said storage means; and a plurality of sound source means for producing a sound signal, each of said sound source means reading said sound scale data from said main storage means, each sound source means comprising sound waveform storage means in which a sound waveform is stored in a digital form, a second programmable counter for dividing an input frequency in response to each sound scale data, an address counter for counting the output of said second programmable counter and advancing the read address of said sound waveform storage means, envelope waveform storage means for storing the envelope waveform in digital form, means for reading the envelope waveform from the envelope waveform storage means, and producing means for producing said sound signal which have an analog sound waveform in response to said each digital sound waveform and is supplied with an analog envelope waveform in response to said each digital envelope waveform, and mixing means for mixing outputs from said producing means of said plurality of sound source means.

18. The sound generating device of claim 17, wherein said main storage means stores a plurality of sound volume data for controlling the plurality of sound source means; and each of said sound source means comprising a adder means for adding said envelope waveform data and said sound volume data, said producing means comprising a first digital to analog conversion circuit for converting a digital output from the adder means to an analog value and a second digital to analog conversion circuit for converting the sound waveform from a digital to an analog value by setting the output voltage of the first digital to analog conversion circuit as a maximum voltage.

19. The sound generating device of claim 17, wherein at least two of said sound source means have sound waveforms of different shapes stored in the respective sound waveform storage means thereof.

20. A sound generating device for generating a sound signal having a sound waveform and an envelope waveform comprising main storage means for storing melody data therein, the melody data including sound length data and a plurality of sound scale data, the main storage mean having read addresses therein; a first programmable counter for dividing a reference frequency in response to said sound length data to provide a signal for advancing the read address of said storage means; and a plurality of sound source means for producing a sound signal, each of said sound source means reading said sound scale data from said main storage means, each sound source means comprising sound waveform storage means in which a sound waveform is stored in a digital form, a second programmable counter for dividing an input frequency in response to each sound scale data, an address counter for counting the output of said second programmable counter and advancing the read address of said sound waveform storage means, envelope waveform storage means for storing the envelope waveform in digital form, means for reading the envelope waveform from the envelope waveform storage means for storing the envelope waveform in digital form, means for reading the envelope waveform from the envelope waveform storage means, and producing means for producing said sound signal which has an analog sound waveform in response to said each digital sound waveform and is supplied with an analog envelope waveform in response to said each digital envelope waveform, and mixing means for mixing outputs from said producing means of said plurality of sound source means, and a speaker for receiving the sound signal and producing a sound in response thereto.

21. A sound generating device comprising a main storage means for storing melody data, the melody data including sound length data and sound volume data, the storage means having memory addresses which are successively read at a speed corresponding to the sound length data; rhythm sound generating means for generating rhythm sounds, the main storage means controlling the rhythm sound generating means in accordance with the melody data; the rhythm sound generating means comprising noise generating means for outputting random pulses, pulse generating means for outputting pulses of a predetermined frequency, envelope waveform storage means for storing a rhythm sound envelope waveform in a digital form; adder means for receiving inputs from said envelope waveform storage means and said sound volume data and adding the envelope waveform and sound volume data to output an added envelope waveform; digital to analog conversion means for converting the added envelope waveform to an envelope waveform in an analog form and means for supplying said envelope waveform in an analog form to a signal output from at least one of said noise generating means and pulse generating means.

22. A sound generating device comprising a main storage means for storing melody data, the melody data including sound length data and sound volume data, the storage means having memory addresses which are successively read at a speed corresponding to the sound length data; rhythm sound generating means for generating rhythm sounds, the main storage means controlling the rhythm sound generating means in accordance with the melody data; the rhythm sound generating means comprising noise generating means for outputting random pulses, pulse generating means for outputting pulses of a predetermined frequency, envelope waveform storage means for storing a rhythm sound envelope waveform in a digital form; adder means for receiving inputs from said envelope waveform storage means and aid sound volume data and adding the envelope waveform and sound volume data to output an added envelope waveform; digital to analog conversion means for converting the added envelope waveform to an envelope waveform in an analog form and means for supplying said envelope in an analog form to a signal output from at least one of aid noise generating means and pulse generating means, and a speaker for receiving the sound signal and producing a sound in response thereto.

23. A sound generating device for generating a sound signal having a sound waveform and an envelope waveform comprising main storage means for storing melody data therein, the melody data including sound length data and sound scale data, the main storage means having read addresses therein; a first programmable counter for dividing a reference frequency in response to said sound length data to provide a signal for advancing the read address of said storage means; a sound source means for producing a sound signal, said sound source means reading said sound scale data form said main storage means, said sound source means comprising sound waveform storage means in which a sound waveform is stored in a digital form, a second programmable counter for dividing an input frequency in response to the sound scale data, an address counter for counting the output of said second programmable counter and advancing the read address of sad sound waveform storage mans, envelope waveform storage means for storing the envelope waveform in digital form, means for reading the envelope waveform from the envelope waveform storage means, and producing means for producing said sound signal which have an analog sound waveform in response to said digital sound waveform and is supplied with an analog envelope waveform in response to said digital envelope waveform.

24. The sound generating device of claim 23, wherein said main storage means stores sound volume data and said sound source means includes adder means for adding said sound volume data to said envelope waveform data, said producing means producing said sound signals which have an analog sound waveform in response to said digital sound waveform and is supplied with an analog envelope waveform in response to said digital envelope waveform added sound volume data.

25. The sound generating device of claim 23 wherein said producing means comprises a first digital to analog conversion circuit for converting said digital envelope waveform data into an analog voltage waveform and a second digital to analog conversion means for receiving said sound waveform data and said analog voltage waveform as a voltage source and converting said digital sound waveform data into said sound signal.

26. A sound generating device for generating a sound signal having a sound waveform and an envelope waveform comprising main storage means for storing melody data therein, the melody data including sound length data and sound scale data, the main storage means having read addresses therein; a first programmable counter for dividing a reference frequency in response to said sound length data to provide a signal for advancing the read address of said storage means; a sound source means for producing a sound signal, said sound source means reading said sound scale data from said main storage means, said sound source means comprising sound waveform storage means in which a sound waveform is stored in a digital form, a second programmable counter for dividing an input frequency in response to the sound scale data, an address counter for counting the output of said second programmable counter and advancing the read address of said sound waveform storage means, envelope waveform storage means for storing the envelope waveform in digital form, means for reading the envelope waveform from the envelope waveform storage means, and providing means for producing said sound signal which has an analog sound waveform in response to said digital sound waveform and is supplied with an analog envelope waveform in response to said digital envelope waveform and a speaker for receiving the sound signal and producing a sound in response thereto.

27. A sound generating device for generating a sound signal having an envelope waveform comprising main storage means for storing melody data therein, said melody data including sound volume data; envelope waveform storage means for storing envelope waveform data in digital form; adder means for adding said sound volume data read from the main storage means to said envelope waveform data read from the waveform storage means; digital to analog conversion means for receiving the output of said adder means and converting said output of said adder means into an analog waveform voltage; producing means having a voltage supply node for receiving said analog voltage waveform and producing said sound signal, said sound signal having a frequency corresponding to a sound scale, said sound signal being output with a waveform corresponding to said analog voltage waveform received at said voltage supply node, said producing means including an output node; and switching means for selectively providing a reference voltage to said supply node, said producing means not producing said sound signal when said switching means provides said reference voltage to said supply node.

28. The sound generating device of claim 27, wherein said main storage means stores sound scale data and further comprising sound waveform storage means for storing sound waveform data in a digital form, the sound waveform data being read from the sound waveform storage means at a frequency corresponding to the sound scale data, said producing means receiving said sound waveform data and said analog waveform being a voltage source for converting said digital waveform data into said sound signal.

29. The sound generating device of claim 27, further comprising a speaker for receiving the sound signal and producing a sound in response thereto.

* * * * *